US008494196B2

(12) United States Patent
Zukic

(10) Patent No.: US 8,494,196 B2
(45) Date of Patent: Jul. 23, 2013

(54) SYSTEM AND METHOD FOR CONFIGURING A HEARING DEVICE

(75) Inventor: Tarik Zukic, Vienna (AT)

(73) Assignee: Two PI Signal Processing Application GmbH, Vienna (AT)

( * ) Notice: Subject to any disclaimer, the term of this patent is extended or adjusted under 35 U.S.C. 154(b) by 444 days.

(21) Appl. No.: 12/827,356

(22) Filed: Jun. 30, 2010

(65) Prior Publication Data

US 2011/0002490 A1 Jan. 6, 2011

(30) Foreign Application Priority Data

Jul. 2, 2009 (EP) ..... 09450125

(51) Int. Cl.
*H04R 25/00* (2006.01)

(52) U.S. Cl.
USPC ..... 381/314

(58) Field of Classification Search
USPC ..... 381/314
See application file for complete search history.

(56) References Cited

U.S. PATENT DOCUMENTS

| | | | | |
|---|---|---|---|---|
| 3,905,131 | A * | 9/1975 | Feezor et al. | 434/221 |
| 5,303,306 | A | 4/1994 | Brillhart et al. | |
| 5,608,803 | A * | 3/1997 | Magotra et al. | 381/314 |
| 5,710,819 | A | 1/1998 | Topholm et al. | |
| 5,835,611 | A * | 11/1998 | Kaiser et al. | 381/321 |
| 6,201,875 | B1 * | 3/2001 | Davis et al. | 381/314 |
| 7,561,920 | B2 * | 7/2009 | Faltys et al. | 607/57 |
| 8,121,298 | B2 * | 2/2012 | Ochi et al. | 381/23.1 |
| 8,155,747 | B2 * | 4/2012 | Faltys et al. | 607/57 |
| 8,199,933 | B2 * | 6/2012 | Seefeldt | 381/104 |
| 8,199,946 | B2 * | 6/2012 | Ritter et al. | 381/314 |
| 8,265,311 | B2 * | 9/2012 | Edgar | 381/315 |
| 2009/0043359 | A1 * | 2/2009 | Smoorenburg | 607/57 |
| 2011/0058699 | A1 * | 3/2011 | Kilsgaard | 381/315 |
| 2011/0249839 | A1 * | 10/2011 | Mindlin et al. | 381/314 |
| 2012/0029593 | A1 * | 2/2012 | Calle et al. | 607/57 |
| 2012/0183163 | A1 * | 7/2012 | Apfel | 381/314 |

FOREIGN PATENT DOCUMENTS

WO WO03032681 4/2003

* cited by examiner

*Primary Examiner* — Jeffrey Donels
(74) *Attorney, Agent, or Firm* — Design IP

(57) ABSTRACT

The invention relates to a system and a method for configuring a hearing device by means of an external configuration unit, the hearing device comprising a microphone, an A/D-converter, a processing unit with a memory, a D/A-converter and a receiver, the external configuration unit comprising a programming host, an external processing unit, an interface and a playing device, the method including the steps of processing a sound recording from the playing device with a parameter setting externally, feeding the processed sound recording to the receiver of the hearing device via the interface and the D/A-converter, emitting the processed sound recording through the receiver, repeating steps a) to c) with varying parameter settings until a match between the quality of the signal and the requirements of the user is reached, and transmitting and storing the chosen parameter setting in the memory of the hearing device.

13 Claims, 3 Drawing Sheets

SYSTEM AND METHOD FOR CONFIGURING A HEARING DEVICE

CROSS REFERENCE TO RELATED APPLICATIONS

The present application claims priority from European Patent Application Number EP 09450125.1, filed on Jul. 2, 2009, which is incorporated herein as if fully set forth.

BACKGROUND OF THE INVENTION

The present invention relates to a system and a method for configuring a hearing device by means of an external configuration unit, said hearing device comprising at least one microphone, at least one A/D-converter, at least one processing unit with a memory, at least one D/A-converter, and at least one receiver/loudspeaker.

"A/D-converter" here stands for an analog-digital converter that converts continuous signals into digital information in discrete form. The reverse operation is performed by an D/A-converter, a digital-analog converter.

Hearing devices usually comprise a microphone to pick up incoming sound waves, a receiver or loudspeaker and a signal processing unit in between that can be individually adapted to different requirements depending on the environment or the disabilities of the user of the hearing device.

Hearing devices might be hearing aids as used by hearing-impaired people but also communication devices or hearing protection devices as used by individuals working in noisy surroundings.

The adjustment of the hearing device to a user's preference and requirements as well as to different environments is a cumbersome procedure, especially without the help of an acoustician or audiologist. The reason for this is the range and complexity of parameters of hearing devices, which can be controlled only by appropriately trained specialist personnel.

Adaptation of the hearing device by configuration of the signal processing unit is done by changing different processing parameters, like gain, dynamic compression ratio, noise reduction strength and the like, until the parameter set that is best suited for the user is determined. Hence, the adaptation or fitting procedure of a hearing device consists of individual evaluation of different parameter sets and a choice of the best set, in most cases by a user with the help of qualified personnel.

According to prior art, the individual adaptation involves the process where a user compares results of different signal processing settings that are presented to him/her consecutively and chooses a preferred one that suits his/her needs best. The initial setting of parameters might be based on an audiogram or similar estimation of hearing impairment.

During the adaptation or fitting procedure, different prerecorded sounds are used to evaluate the effect of signal processing. The sounds, played from an audio device, e.g. a stereo, a CD-player or a PC, are picked up by the microphone of the hearing device, processed using the signal processing with the latest set of parameters and provided to the ear of the individual via the receiver.

In a variant of common fitting procedures, an interface like "NoahLink" or other frequency-modulating tools or Bluetooth-streaming devices might be used to feed reference sounds directly into the device. In this case the microphone of the hearing device is bypassed, thus also neutralizing the negative influence of disturbing sounds of the surrounding area.

The evaluation is usually done by comparison of a signal with the latest processing parameters with a signal processed with a previous set of parameters. The evaluating person makes a choice by his/her auditory preference. The outcome of the fitting procedure is influenced by the ability of the user of the hearing device to remember the sound preference before the latest parameter change. This ability usually decreases over time, especially, when the fitting procedure lasts very long.

SUMMARY OF THE INVENTION

The present invention sets out to overcome the above-mentioned shortcomings of the prior art by providing an easy to implement and straightforward way of configuring the parameter setting of a hearing device to the needs of a user.

This task is solved by a method according to the invention, wherein the external configuration unit comprises at least one programming host, at least one external processing unit, at least one programming interface and a playing device to play sound recordings, said method comprising the following steps:

a. processing a sound recording from the playing device with a parameter setting in the external processing unit of the external configuration unit,
b. feeding the processed sound recording to the receiver of the hearing device via the interface and the D/A-converter, bypassing the microphone, the A/D-converter and the processing unit of the hearing device,
c. emitting the processed sound recording through the receiver of the hearing device,
d. repeating steps a), b) and c) with varying parameter settings until a match between the quality of the signal and the requirements of the user of the hearing device is reached, and
e. transmitting the chosen parameter setting to the hearing device and storing it in the memory of the hearing device.

By virtue of this solution it is possible to perform the configuration of a hearing device in a faster, easier and, eventually, cheaper way. Since the parameter set used for the processing of the sound recordings is not changed in the hearing device but in the external configuration unit, no fitting room, no special environment and, in principle, neither acoustician nor audiologist are needed for the configuration of the hearing device. Instead, the configuration could even be done independently by the user of the hearing device, when a PC, a handheld device or a mobile phone is used as external configuration unit. This is possible because the whole procedure can be implemented as a software application.

The playing device that delivers the sound recordings may be a hi-fi system or the like, delivering analog sound recordings, optionally in combination with a streaming device that converts the recordings into digital information.

The parameter set used for the processing of the sound recordings comprises parameters like gain, dynamic compression rate; dynamic compression thresholds, noise reduction strength and the like. The parameter set applied in the method depends on the requirements of the user and/or the environment the hearing device will be used in. In the iterative process, the parameter sets are adapted following a specific rule, for instance: one parameter could be changed while the others remain unchanged; all parameters could be changed to realize values for common situations or comparable users, and the like. The transmission of the processed signal into the hearing device can be done in various ways, e.g. using cables, wireless interfaces and the like.

The user hears the different sound recordings through the receiver and decides whether the new parameter set is an improvement to previous ones, or not. In an advantageous variant of the invention, in step a) at least two sound recordings are processed at the same time with different parameter settings and mixed into one joint signal before step b), wherein after step c) one of the parameter settings is retained and the other one is replaced by a new parameter setting. This means that the user hears more than one sound recording at a time, e.g. in the form of a conversation of two partners. It is, however, possible to play the same recording, changing the parameter setting used to process the recording.

The user has the opportunity to immediately compare two sound recordings (and, consequently, two parameter sets) and decide for the one that suits his/her needs best. Thus, it is no longer necessary to remember the impression of former parameter sets which proved to be a problem in the past.

The example of a conversation between two partners is only one of many options. It is also possible to mix the recordings of two musical instruments, environmental noise, animals and the like. Abovementioned variant of the method is only possible because two sound recordings can be processed with different parameter sets at the same time and be fed into the hearing device at once, giving the user the opportunity to compare two parameter sets and their influence on the sound recordings on the spot.

Preferably, in step b) the interface uses a wireless connection or telephone network between the external configuration unit and the hearing device. This allows for a better usability of the system, since it is not necessary for the user of the hearing device to be at the same place with the external configuration unit.

In a preferable variant of the invention, the external configuration unit comprises at least one screen and in step c), the emitting of the processed sound recording is accompanied by the playback of visual signals on the screen, visible to the user of the hearing device. In case a dialogue between two partners is played to a user, a video output would display two people talking to each other. Thus, in step c) each sound recording is represented by a figure pictured on the screen.

This improves the situation for the user, giving him the opportunity to focus on the quality of the sound recordings he is listening to. In order to prevent the results of the configuration process to be spoiled by any sympathies of the user towards any of the conversation partners (in case a dialogue is shown) it is also possible to show an animated film with neutral-looking or even identical figures.

The abovementioned task is further solved by a system according to the invention, wherein the external configuration unit comprises at least one programming host, at least one external processing unit, at least one interface and at least one playing device to reproduce sound recordings.

By virtue of this solution, it is possible to perform the configuration of a hearing device in a faster, easier and, eventually, cheaper way. The playing device can reproduce sound recordings in various forms, e.g. compressed formats (like MP3s), uncompressed sounds (like in the Wave-Format) and the like.

Preferably, the memory of the hearing device is non volatile. This means that the information stored in the memory is retained even if the hearing device is not powered.

Furthermore, the external configuration unit further comprises a screen to display visual information. The screen can have various forms, e.g. a conventional TV-screen, a TFT-, LCD- or cathode ray tube-display, but also the screen of a mobile device like a laptop, mobile phone or portable player of various kinds.

In a variant of the system according to the invention, the interface employs a wireless connection between the external configuration unit and the hearing device. This wireless connection might be of different kinds known to the skilled person in the art, like WLAN, Bluetooth and the UMTS-network.

BRIEF DESCRIPTION OF THE DRAWINGS

In the following, the present invention is described in more detail with reference to the drawings, which show.

DETAILED DESCRIPTION OF THE PREFERRED EMBODIMENTS

It should be appreciated that the invention is not restricted to the following embodiments which merely represent one of the possible implementations of the invention. Furthermore, it is noted that the representations in the figures are only schematic for the sake of simplicity.

Figure 1:
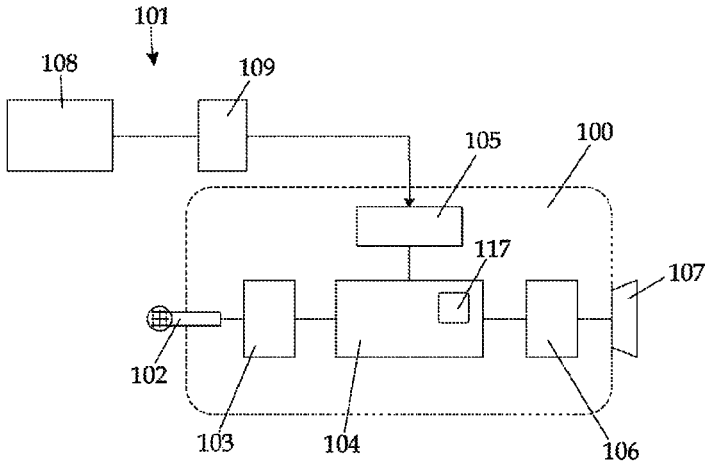
FIG. 1 is a schematic view of the main components of a hearing device applying the method according to the invention.

FIG. 1 shows a schematic view of a digital hearing device 100. The method according to the invention is applied to such a hearing device 100, using an external configuration unit 101. The external configuration unit 101 is not part of the hearing device 100 but used for the configuration procedure.

The hearing device 100 comprises a microphone 102 to pick up incoming sound waves. The signals of the microphone 102 are then transformed by an A/D-converter 103, creating a digital signal from the analog input. The digital signal is fed into a processing unit 104 and processed—the processing can either be implemented as software for a processor on a digital device or hard-wired as an integrated circuit.

The processing unit 104 applies routines on the signal to vary a number of its parameters. The current parameter setting 105 is usually stored in a RAM memory of the processor, preferably a non-volatile memory 117 like an EEPROM (Electrically Erasable Programmable Read Only Memory). However, for configuring- or fitting purposes, the parameter settings 105 may also be adjusted externally. Examples for the varying parameters of the signal are gain, dynamic compression ratio, dynamic compression thresholds, noise reduction strength and the like. A parameter setting 105 is a set of values of each of the parameters.

After the processing, the signal is fed through a D/A-converter 106 to obtain an analog signal. The analog signal is then output through a receiver 107, i.e. a loudspeaker, to the ear of the user of the hearing device 100.

For fitting the hearing device 100 to the needs of the user, an external configuration unit 101 is used. This unit 101 basically comprises a programming host 108 and a programming interface 109. The programming host 108 may be a PC, a hand-held device or the like. Furthermore, a device to play recorded sound signals and some other equipment may be used in the fitting procedure—however, such equipment is not shown in FIG. 1 for the sake of simplicity.

The programming interface 109 serves to transmit the commands of the programming host 108 to the hearing device 100. It can also comprise the features of an audio-streaming device, transmitting sound recordings from the external configuration unit 101 to the hearing device 100. The transmission could be effected either by use of cables and serial connections or wirelessly, depending on the type of interface 109. Thus, the interface 109 may have transmission and receiving means, e.g. in the form of antennae, to connect via a wireless network or a computer network. FIG. 1 shows only a schematic view of an interface, not being specific about the nature of the transmission, hence not excluding any of the above mentioned possibilities.

The programming interface 109 may be an interface like HiPro, NoahLink and the like. The latter two are well established standards in the field of hearing devices and used to program such devices. NoahLink is a hearing device programming interface for use with HIMSA (Hearing Instruments Manufacturers Software Association)-certified hearing devices and respective programs. NoahLink utilizes the high-speed wireless technology Bluetooth. However, other forms of interfaces may be used as well; in principle, a simple cable, allowing feeding of programming and/or audio information to the hearing device 100, might suffice. Another, much more elaborate would be a telephone or wireless network, connecting the hearing device 100 with the external configuration unit 101.

The incorporated signal processing of hearing devices 100 has to be adapted (fitted) to the individual hearing deficiencies of a user or the acoustic environment where the device is used, in most cases by configuration of the parameters (e.g., the parameter setting 105). In the broadest sense, the individual adaptation involves the process where a user repeatedly compares two (or more) signal processing settings (i.e., signals, processed by application of two different parameter settings) and chooses the one that results in the better quality of the signal.

Figure 2:
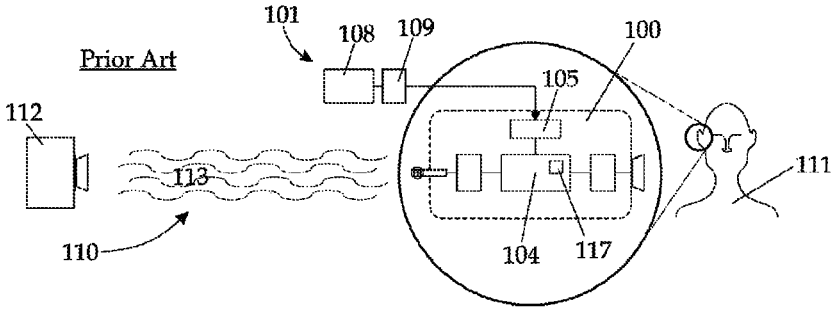
FIG. 2 is a method for configuring a digital hearing device according to prior art.

A prior art-method for configuring a hearing device, e.g. a digital hearing aid, is shown in FIG. 2. This method is usually performed in a fitting room 110 at a physician's or an audiologist's. Such a fitting room 110 is a soundproof facility to exclude environmental noise to yield better results of the fitting process.

In this method, a person—further referred to as user 111—using the hearing device 100 is exposed to different sound recordings 113. The sound recordings are pre-recorded, stored and reproduced from a player 112, e.g. a hi-fi system, PC, handheld device and the like.

The sound recordings 113 are reproduced acoustically in the fitting room 110. The user 111 listens to the sound recordings while different parameter settings 105 are fed into the processing unit 104 from the external configuration unit 101: The programming host 108 of the external configuration unit 101 applies different parameter settings 105 to the processing unit 104 via the interface 109.

The hearing device 100 processes the sound applying the respective parameter setting 105. Every time a new parameter setting 105 is applied, the user 111 listens to the sound recording 113 and has to decide whether the listening experience is better or worse than with the previous parameter setting 105. Naturally, the success of this fitting method relies on the ability of the user 111 to remember the effect of previous parameter settings 105—an ability which decreases over time because of increasing fatigue the longer the configuration process takes.

Once a parameter setting 105 is determined that fits the user's 111 needs best it is stored permanently in the hearing device 100, e.g. in a non-volatile memory 117 (EEPROM).

Summarizing, in this first method according to prior art, sound recordings 113 are played to a user 111 and the parameter setting 105 of the processing unit 104 of the user's hearing device 100 is specified by the external configuration unit 101. Once a suitable parameter set 105 is determined it is stored in a non-volatile memory 117 of the hearing device 100.

Figure 3:
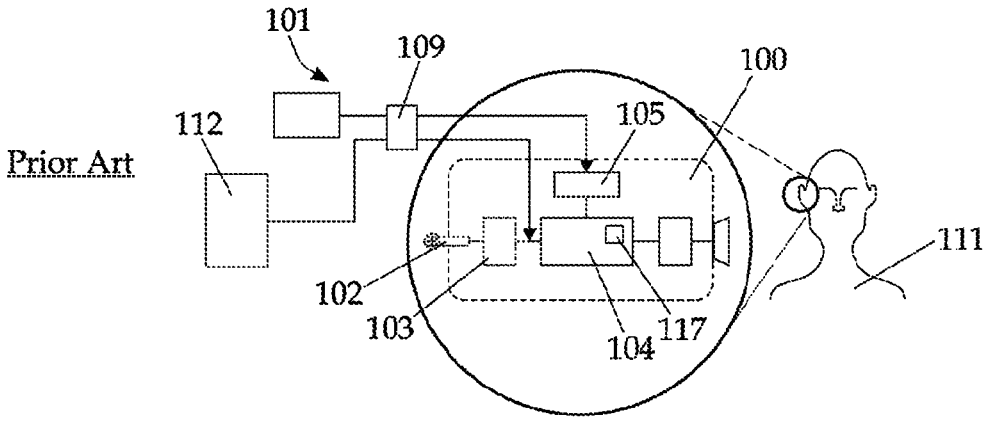
FIG. 3 is another method for configuring a digital hearing device according to prior art.

FIG. 3 shows another prior art-method for the fitting of a hearing device. Again, a user 111 with a hearing device 100 is exposed to different sound recordings. However, in this method, the sound recordings are not played and picked-up by the microphone 102 of the hearing device 100. Instead, the sound recordings coming from a player 112 (in most cases, the recordings will be in a digital format) are fed directly into the hearing device 100 via the programming and streaming interface 109. Hence, no fitting room (110 in FIG. 2) is needed and the requirements for properly applying the method are eased (no special premises necessary, influence of environmental noise diminished).

The directly fed signal is adjusted in level and frequency to correspond to the environmental sound signal that would be picked up by the microphone. This is possible since the sensitivity of the microphone is known.

The sound recordings are transmitted as digital signals and fed in the hearing device 100 after the A/D-converter 103 (i.e. between the A/D-converter 103 and the processing unit 104). The microphone 102 and the A/D-converter 103 are bypassed. For the sake of clarity, the bypassed parts of the hearing device 100 are pictured in dotted lines in FIG. 3. The further processing is identical to the method described in FIG. 2: The parameter setting 105 applied by the processing unit 104 is controlled externally by the external configuration unit 101. Once the best parameter setting 105 is determined, it is stored permanently in a non-volatile memory 117 of the hearing device 100.

Summarizing, in this second method according to prior art there is no free transmission of the sound recordings, but rather a direct injection of the digitalized signal into the hearing device 100 after the A/D-converter 103. Different parameter sets 105 are fed into the processing unit 104 from the external configuration unit 101 one after the other; the best-suited parameter set is then stored in a non-volatile memory of the hearing device 100.

In both methods according to prior art, the parameter settings 105 used by the processing unit 104 are specified by the external configuration unit 101. Only one parameter setting 105 after the other can be evaluated.

Figure 4A:
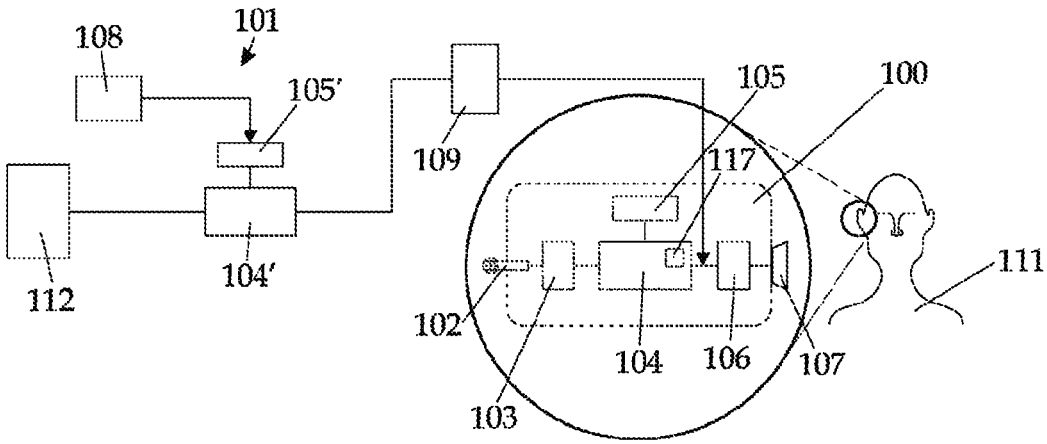
FIG. 4*a* is a first step of the method for configuring a digital hearing device according to the invention.
Figure 4B:
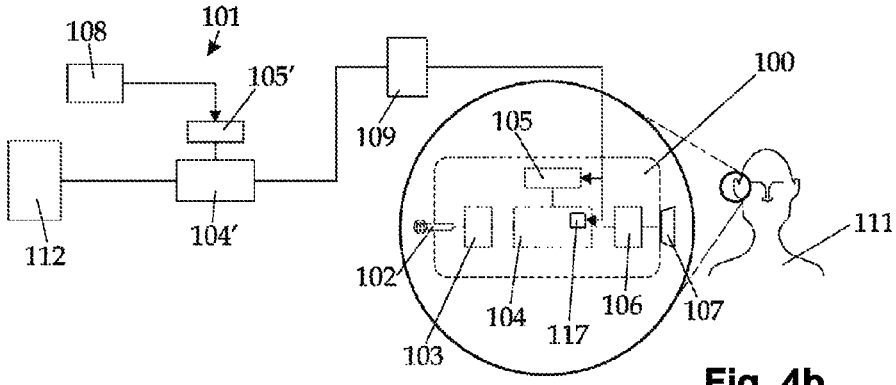
FIG. 4*b* is a second step of the method according to the invention.

The method for configuring a hearing device according to the invention basically comprises two steps, pictured in FIGS. 4*a* and 4*b*. Here, not only the specification of the parameter setting 105, but also the processing is done externally. Therefore, the relevant signal processing is not done in the hearing device 100 but is performed in the external configuration unit 101. The external configuration unit comprises a programming host 108, an external processing unit 104' (applying a parameter setting 105'), a player 112 and a programming interface 109.

In the first step, depicted in FIG. 4*a*, a sound recording (either digital or analog) from a player 112 is fed into an external processing unit 104'. The sound recordings are prerecorded, stored and reproduced by the player, which can be a PC, handheld computer, hi-fi system or similar device.

The programming host 108 of the external configuration unit 101 configures a parameter setting 105' that is used in the external processing unit 104' to process the sound recordings. Via the interface 109, the processed recordings are then fed into the hearing device 100, i.e. to the receiver 107 of the hearing device 100 via the interface 109 and the D/A-converter 106. This means that the processed signal is fed into the hearing device before the D/A-converter 106, or after the internal processing unit 104, respectively. The receiver 107 then outputs the processed signal. The other components of the hearing device 100, i.e. microphone 102, A/D-converter 103 and processing unit 104 are bypassed. This fact is illustrated by picturing said components in FIG. 4*a* in the form of dotted lines.

In principle, it is also possible to input an analog audio signal which is then processed by the external configuration unit 101 and fed into the A/D-converter 103 of the hearing device 100. In this case the internal processing unit 104 of the hearing device 100 has to be bypassed.

Once a suitable parameter setting 105' is determined, step two of the method (FIG. 4*b*) is initiated. The determined parameter setting 105' is transferred to the hearing device 100 and copied into the non-volatile memory 117 of the hearing device 100 or its processing unit 104, respectively. It has to be noted that this is the only time in the whole process where any modifications are carried out in the hearing device 100. Apart from that, all modifications are effected outside of the hearing device 100 and only the processed sound recordings are fed in the D/A-converter 106 of the hearing device 100. The events of step two are signified by the arrows in FIG. 4*b*: The determined parameter setting 105' becomes the parameter setting 105 in the hearing device and is stored in the non-volatile memory 117 of the device.

In principle, it is also possible to store all possible parameter settings 105 in a table in the memory 117 of the hearing device 100. Once step two of the method is completed, not all the values of the parameters, but merely the information, which entry of the table has to be applied, is transmitted to the hearing device via the interface 109. The outcome, however, is the same: a configured hearing device 100 with a parameter setting 105, stored in the memory 117.

The processing in the external processing unit 104' corresponds exactly to the processing that would go on internally, in the processing unit 104 of the hearing device 100. The advantages of this method are apparent at once: In the methods according to prior art it is necessary to consecutively apply different parameter sets on the recording via the internal processing unit of the hearing device and play the processed sound bits to the user one after the other. The user then decides from remembering the different sound bits which parameter set suits his/her needs best. Thus, the outcome of the fitting procedure is influenced by the ability of the user of the hearing device to remember the sound properties before the latest parameter change; furthermore, modifications have to be done to the hearing device, requiring suitable equipment, well trained staff (e.g., a physician or an audiologist) and apt premises.

The method according to the invention allows for a totally different approach: Since the sound recordings are processed outside of the hearing device and the internal parameter set of the hearing device does not have to be changed, it is possible to play sound recordings that are processed with different parameter sets in parallel. Instead of comparing a sound recording with a parameter set B with the memory of a sound recording with a parameter set A, the user can listen to sound recordings with parameters A and B alternately and simply decide which of them suits his/her needs better.

Figure 5A:
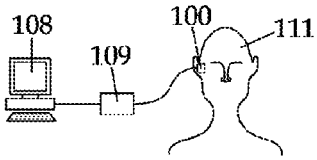
FIG. 5*a, b, c* are variants of the application of the system and the method according to the invention.
Figure 5B:
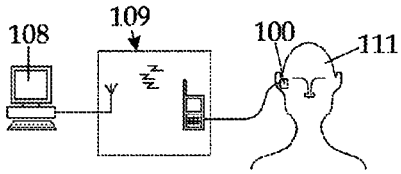
Figure 5C:
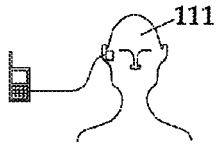

Furthermore, the method according to the invention allows, in principle, for at least three different configurations, depicted in FIGS. 5*a* to 5*c*: In FIG. 5*a*, the external processing unit 108 of the configuration unit is contained in a PC. The data from the external processing unit 108 is transferred to the user's 111 hearing device 100 via cables and an interface 109. As explained before, the interface 109 serves as programming and audio-streaming interface, transmitting the audio information as well as the determined parameter settings after successful completion of the method according to the invention.

FIG. 5*b* shows an arrangement where the interface 109 allows for a wireless transfer of the audio information (e.g., the sound recordings) as well as the commands of the external processing unit 108. This wireless interface is embodied by an antenna and a mobile phone in FIG. 5*b*. However, this is only schematic, other embodiments are possible as well. The well established NoahLink-System, Bluetooth based streaming devices or other devices applying broadcasting techniques (e.g. frequency-modulated systems) could be used as interface. With the arrangement of FIG. 5*b* the user of a hearing device 100 can perform the configuration or fitting procedure wherever he/she wants to do it, simply by wirelessly connecting to the configuration unit 101.

FIG. 5*c* shows yet another arrangement, where the external configuration unit 101 (including the interface) is housed in a mobile device, e.g. a mobile phone (again, this is only one embodiment. Other mobile or portable devices may be used as well). The method may be stored in the mobile phone in the form of software, with a database of sound recordings to perform the method according to the invention. By that means the user 111 of the hearing device can perform the fitting procedure anywhere, anytime, just by connecting the hearing device 100 to the mobile phone.

Figure 6:
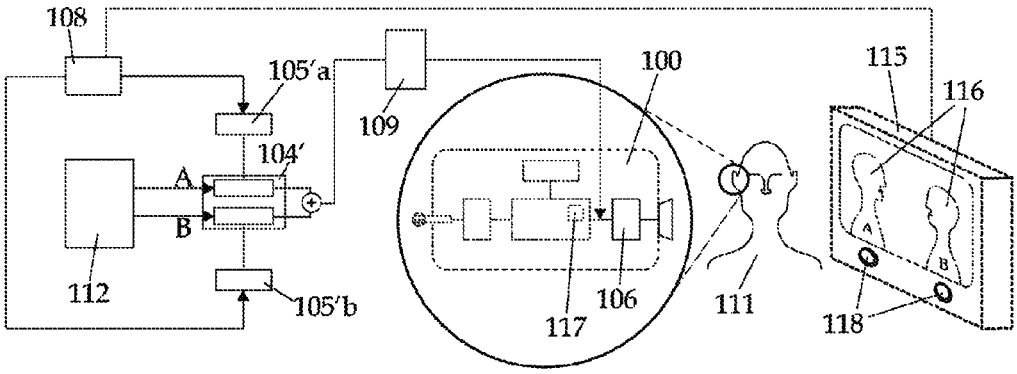
FIG. 6 is a variant of the method according to the invention.

FIG. 6 shows a more elaborate application of the method according to the invention. A player 112 provides two sound bits "A" and "B". The sound bits "A", "B" might stem from the same recording or from different recordings. "A" might be the recording of one speaker, whereas "B" could be the recording of a second speaker; "A" might be one instrument, "B" might be a second instrument, and the like. Alternatively, "A" and "B" might stem from a recording of one speaker, for instance. The pre-recorded sound bits might also represent a recording of two or more different sound sources. The sources can be human speakers in conversation or a restaurant situation, but may also be instruments playing, traffic noise and the like.

The sound bits "A", "B" are then processed separately in the external processing unit 104', applying different parameter settings 105'*a*, 105'*b* that are provided by the programming host 108. The term "different parameter setting" here means that, for instance, the value for the gain differs in the two parameter settings 105'*a*, 105'*b*, to name only one of many possible examples. In principle it is also possible to use more than two sound bits. The separate processing is illustrated in FIG. 6 by two separate blocks in the box that signifies the processing unit 104'.

After the processing, the sound bits "A", "B" are mixed, transmitted to the hearing device 100 as a digital signal and fed into the hearing device 100 before the D/A-converter 106 by means of the interface 109, which again serves as an audio-streaming interface as well as an programming interface (explained below). The user 111 then decides which of the sound bits "A", "B" has a better quality: Rather than choosing between sound recordings before and after the change of the parameter sets, the user 111 can choose between two or more distinguishable sound bits at the same time, all of which are processed with different signal processing settings (i.e. parameter settings).

The signal bits may also be supported by video footage. The example sounds may be combined with a video showing conversation of two (or more) partners. These partners might be human, however, it is also possible to generate animated figures to prevent sympathizing that might superimpose the objective perception. This variant of the invention is schematically depicted in FIG. 6 with dashed lines. The dashed structures comprise a screen 115, showing two figures 116. The screen 115 could be a conventional TV-screen, a TFT-, LCD- or cathode ray tube-display, but also the screen of a mobile device like a laptop, mobile phone or portable player of various kinds.

The application of the method according to the invention typically comprises an iteration of the following steps: At least two tracks of sound recordings are processed in an external processing unit with separate parameter settings. The processed sound recordings are mixed and transmitted as a digital signal and fed into the hearing device after the processing unit 104 and before the D/A-converter 106, bypassing the processing unit 104. In case an analog signal is transmitted, it can be fed in the A/D-converter, but in this case the internal processing in the hearing device 100 is bypassed. The sound recordings could be, for instance, a discussion between two speakers, recorded on two separate tracks so that each person can be processed separately with different parameter sets. The user listens to the two sound recordings or the discussion of the two speakers, respectively. He/She then decides which of the two speakers is better understandable, i.e., which processing suits him/her better.

The parameter setting of the chosen sound recording is retained, a second sound recording (which can also be the sound recording that has already been used), processed with a new parameter setting, is mixed with the "surviving" sound recording of the first round. The new parameter set is determined by a rule of choice.

The processing parameters that are alternated are in most cases: acoustical gain, compression ratio and frequency equalization. Alternation of other parameters is also possible. The variation of the parameters can for example start with slightly different gains for sound bit A and B. If the user prefers the bit processed with the higher value for the gain, the next parameter set generation will include the surviving higher value and a new value closer to the surviving gain than to the discarded gain.

The whole process is iterated until the user qualifies the two tracks of sound recordings indistinguishable, i.e., he/she can no longer decide which one is better.

The resulting parameter setting is then transferred to the hearing device via the interface 109 and fed into a non-volatile memory of the hearing device. This process step is not explicitly depicted in FIG. 6, but in principle the proceedings are the same as depicted in FIG. 4*b*: The determined parameter setting 105' (a or b) becomes the permanent parameter setting 105 of the hearing device 100 and is stored in the non-volatile memory 117. It has to be noted that this is the first and only time where a direct modification is effected in the hearing device—all the other modifications to sound recordings and parameter sets are done externally.

While the principles of the invention have been described above in connection with preferred embodiments, it is to be clearly understood that this description is made only by way of example and not as a limitation of the scope of the invention.

The invention claimed is:

1. A method for configuring a hearing device by means of an external configuration unit, said hearing device comprising:

at least one microphone,
at least one A/D-converter,
at least one processing unit with a memory,
at least one D/A-converter, and
at least one receiver, said external configuration unit comprising:

at least one programming host,
at least one external processing unit,
at least one programming interface, and
a playing device to play sound recordings, the method comprising the following steps:

a) processing at least two sound recordings from the playing device with different parameter settings, wherein the at least two sound recordings are processed at the same time and mixed into one joint signal,
b) feeding the processed sound recordings to the receiver of the hearing device via the interface,
c) emitting the processed sound recordings through the receiver of the hearing device,
d) repeating steps a), b) and c) with varying parameter settings wherein the parameter setting of one of the at least two sound recordings is retained and the parameter setting of the other of the at least two sound recordings is replaced by a new parameter setting until a match between the quality of the signal and the requirements of the user of the hearing device is reached, and
e) transmitting the chosen parameter settings to the hearing device and storing them in the memory of the hearing device.

2. The method according to claim 1, wherein in step b), the interface uses a wireless connection or telephone network between the external configuration unit and the hearing device.

3. The method according to claim 1, wherein the external configuration unit comprises at least one screen and in step c) the emitting of the processed sound recordings is accompanied by the playback of visual signals on the screen, visible to the user of the hearing device.

4. The method according to claim 3, wherein in step c) each processed sound recording is represented by a figure pictured on the screen.

5. A system for configuring a hearing device by means of an external configuration unit, wherein said hearing device comprises:

at least one microphone,
at least one A/D-converter,
at least one processing unit with a memory,
at least one D/A-converter, and
at least one receiver, and said external configuration unit comprises:

at least one programming host,
at least one external processing unit,
at least one programming interface, and
at least one playing device to reproduce audio- and/or visual information, the system further comprising:

a) means for processing at least two sound recordings from the playing device with different parameter settings at the same time and mixing the at least two sound recordings into one joint signal,
b) means for feeding the processed sound recordings to the receiver of the hearing device via the interface, c) means for emitting the processed sound recordings through the receiver of the hearing device, d) means for repeating a), b) and c) with varying parameter settings so that the parameter setting of one of the at least two sound recordings is retained and the parameter setting of the other of the at least two sound recordings is replaced by a new parameter setting until a match between the quality of the signal and the requirements of the user of the hearing device is reached, and e) means for transmitting the chosen parameter settings to the hearing device and storing them in the memory of the hearing device.

6. The system of claim 5, wherein the memory of the hearing device is non-volatile.

7. The system of claim 5, wherein the playing device of the external configuration unit comprises a screen to display visual information.

8. The system according to claim 5, wherein the interface employs a wireless connection between the external configuration unit and the hearing device.

9. The method of claim 1, wherein the step of processing the at least two sound recordings from the playing device with different parameter settings occurs in the external processing unit of the external configuration unit.

10. The method of claim 1, wherein step b) further comprises feeding the processed sound recordings to the receiver of the hearing device via the interface and the D/A-converter and bypassing the microphone, the A/D-converter, and the processing unit of the hearing device.

11. The system of claim 5, wherein the means for processing the at least two sound recordings from the playing device with different parameter settings at the same time and mixing the at least two sound recordings into one joint signal is located in the external processing unit of the external configuration unit.

12. The system of claim 5, wherein the means for feeding the processed sound recordings to the receiver of the hearing device via the interface is also used to feed the processed sound recordings to the D/A converter, but not to the microphone, A/D-converter, or the processing unit of the hearing device.

13. A method for configuring a hearing device by means of an external configuration unit, said hearing device comprising:

at least one microphone,
at least one A/D-converter,
at least one processing unit with a memory,
at least one D/A-converter, and
at least one receiver, said external configuration unit comprising:

at least one programming host,
at least one external processing unit,
at least one programming interface, and
a playing device to play sound recordings, the method comprising the following steps:

a) processing at least two sound recordings from the playing device with different parameter settings, wherein the at least two sound recordings are processed at the same time and mixed into one joint signal in the external processing unit of the external configuration unit, b) feeding the processed sound recordings to the receiver of the hearing device via the interface and the D/A-converter, bypassing the microphone, the A/D-converter, and the processing unit of the hearing device, c) emitting the processed sound recordings through the receiver of the hearing device, d) repeating steps a), b) and c) with varying parameter settings, wherein the parameter setting of one of the at least two sound recordings is retained and the parameter setting of the other of the at least two sound recordings is replaced by a new parameter setting until a match between the quality of the signal and the requirements of the user of the hearing device is reached, and e) transmitting the chosen parameter settings to the hearing device and storing them in the memory of the hearing device.

* * * * *